US008091399B2

(12) United States Patent
Beppu

(10) Patent No.: US 8,091,399 B2
(45) Date of Patent: Jan. 10, 2012

(54) PROCESS FOR MANUFACTURING A SEAMLESS TUBE

(75) Inventor: Kenichi Beppu, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 518 days.

(21) Appl. No.: 11/790,875

(22) Filed: Apr. 27, 2007

(65) Prior Publication Data

US 2008/0011037 A1 Jan. 17, 2008

Related U.S. Application Data

(63) Continuation of application No. PCT/JP2005/019906, filed on Oct. 28, 2005.

(30) Foreign Application Priority Data

Oct. 28, 2004 (JP) ..... 2004-313737

(51) Int. Cl.
*B21B 17/10* (2006.01)

(52) U.S. Cl. ..... 72/208

(58) Field of Classification Search ..... 72/97, 208, 72/209

See application file for complete search history.

(56) References Cited

U.S. PATENT DOCUMENTS 4,827,750 A * 5/1989 Hayashi ..... 72/97
5,141,566 A * 8/1992 Kitayama et al. ..... 148/670

FOREIGN PATENT DOCUMENTS

| | | |
|---|---|---|
| EP | 0 828 007 A1 | 3/1998 |
| EP | 0 842 715 A1 | 5/1998 |
| JP | 1-247532 | 10/1989 |
| JP | 3-162527 | 7/1991 |
| JP | 4-168221 | 6/1992 |
| JP | 04-191325 | 7/1992 |
| JP | 06-330170 | 11/1994 |
| JP | 10-140249 | 5/1998 |
| JP | 10-140283 | 5/1998 |
| JP | 2001-049343 | 2/2001 |
| JP | 2002-194501 | 7/2002 |
| JP | 2002-294339 | 10/2002 |
| JP | 2002-361304 | 12/2002 |
| JP | 2003-171738 | 6/2003 |
| JP | 2003-201541 | 7/2003 |
| JP | 2004-027303 | 1/2004 |

* cited by examiner

*Primary Examiner* — Teresa Ekiert
(74) *Attorney, Agent, or Firm* — Clark & Brody

(57) ABSTRACT

A process for manufacturing a seamless tube which can effectively suppress thickness deviations which are apt to occur in thin-walled seamless tubes is provided. A billet which has been soaked in a heating furnace at a given temperature for a given length of time is subjected to piercing and elongation rolling to form a mother tube, which is then soaked in a reheating furnace at a given temperature for a given length of time and then subjected to sizing to produce a seamless tube with a wall thickness of at most 4 mm. The wall thickness of the tube after sizing is at most 4 mm, the soaking time at the given temperature in the heating furnace is in the range of [billet diameter (mm)×(from 0.14-0.35 )] minutes, and the soaking time at the given temperature in the reheating furnace is in the range of [mother tube wall thickness (mm)×(from 3.0-10.0)] minutes.

14 Claims, 5 Drawing Sheets

(a)

(b)

(a)

(b)

PROCESS FOR MANUFACTURING A SEAMLESS TUBE

This application is a continuation of International Patent Application No. PCT/JP2005/019906, filed Oct. 28, 2005. This PCT application was not in English as published under PCT Article 21(2).

TECHNICAL FIELD

This invention relates to a process for manufacturing a seamless tube. Specifically, this invention relates to a process for manufacturing a seamless tube which can effectively suppress the occurrence of thickness deviations, and it particularly relates to a process for manufacturing a tube for an air bag inflator.

BACKGROUND ART

In recent years, in order to increase the safety of passengers at the time of a collision, air bag systems are being actively installed in automobiles. The initial air bag systems were a type employing explosive chemicals. This type was expensive, and it could result in environmental pollution or safety problems when automobiles were discarded. Therefore, a hybrid system using an inflator made of a steel filled with an inert gas such as argon gas (referred to in this specification as a "air bag inflator") along with an explosive chemical was developed as a new type of air bag system. This has been extensively used as an air bag system for passenger seats which allow an increased capacity for the system. A seamless tube manufactured by the so-called Mannesmann process is often used as a tube for an air bag inflator of this hybrid system.

When manufacturing a seamless tube by the Mannesmann process, first, a raw material in the form of a billet is heated to 1150-1280° C. in a rotary hearth heating furnace. The billet is then subjected to piercing using a plug and grooved rolls of a piercer to produce a hollow shell body. The hollow shell body with a mandrel bar inserted inside it is elongated by an elongator to form into a mother tube while the outer surface of the hollow shell body is constrained by the grooved rolls of the elongator usually having 5 to 8 stands. The wall thickness of the hollow shell body is thereby reduced to a predetermined value. The mandrel bar is then pulled out of the resulting mother tube, and after the mother tube is reheated to a temperature of 850-1100° C. in a reheating furnace as required, the mother tube is subjected to sizing in a reducer so as to form a seamless tube having a predetermined outer diameter. In this manner, a seamless tube product is manufactured.

In recent years, due to demands for decreases in weight and the like, there has been a tendency to further decrease the wall thickness of tubes for use as air bag inflators. However, if the amount of deviation in the circumferential direction of the wall thickness of a tube for air bag inflator (referred to below as "thickness deviation") is large, it becomes necessary to provide a larger allowance for wall thickness, and it is no longer possible to meet demands for decreases in wall thickness. Quality control for a conventional tube for an air bag inflator employs the same wall thickness tolerance as for cold finished tubes for boilers, and it is typical for the tolerance of the wall thickness of such a tube to be in the range of 0-20%.

As disclosed in Patent Documents 1-7, for example, there have been many proposals up to the present time with respect to processes of manufacturing tubes for air bag inflators.

Patent Document 1: JP 10-140249 A1
Patent Document 2: JP 10-140283 A1

Patent Document 3: JP 2001-49343 A1
Patent Document 4: JP 2002-294339 A1
Patent Document 5: JP 2003-171738 A1
Patent Document 6: JP 2003-201541 A1
Patent Document 7: JP 2004-27303 A1

DISCLOSURE OF INVENTION

Problem which the Invention is to Solve

Thickness deviations caused by deformation of the shape of the inner surface or outer surface of a tube for an air bag inflator can be eliminated by subjecting the tube to cold rolling subsequent to sizing. In contrast, of thickness deviations occurring in thin-walled seamless tubes such as seamless tubes for pressure vessels including seamless tubes for air bag inflators., thickness deviations which occur when the circular inner surface or outer surface is eccentric with respect to the central axis of the tube having the shapes of the inner surface and the outer surface which are not deformed are difficult to eliminate even if cold drawing is performed thereon. Accordingly, there is a need to effectively suppress the occurrence of thickness deviations at the time of the completion of sizing.

However, Patent Documents 1-7 contain no disclosure or suggestion concerning a means for effectively suppressing the occurrence of thickness deviations at the time of the completion of sizing.

In particular, they contain no disclosure or suggestion concerning a means which can effectively suppress the occurrence of thickness deviations in a thin-walled seamless tube for an air bag inflator having a wall thickness of at most 4 mm and which can thereby decrease the wall thickness of a seamless tube for an air bag inflator without deviating from a control range (tolerance).

The present invention was made in light of such problems of the prior art, and its object is to provide a process for manufacturing a seamless tube which can effectively suppress the occurrence of thickness deviations in thin-walled seamless tubes such as seamless tubes for pressure vessels including those for air bag inflators.

Means for Solving the Problem

As a result of diligent investigations by the present inventors in order to solve the above-described problem, they found that by suitably setting the soaking time in a heating furnace and the soaking time in a reheating furnace, not only can the occurrence of thickness deviations in a seamless tube manufactured by the Mannesmann process be suppressed, but the amount of thickness deviations in thin-walled seamless tubes having a wall thickness of at most 4 mm such as seamless tubes for pressure vessels including tubes for air bag inflators, for example, can be suppressed extremely effectively to at most 0.4 mm, and that as a result, it is possible to greatly reduce the tolerance of the wall thickness of a seamless tube for an air bag inflator to approximately 10% of the target value of the wall thickness, and they completed the present invention.

The amount of thickness deviation indicates the maximum difference between the maximum value and the minimum value of the wall thickness in cross section of a tube when this difference is measured over the entire length of the tube.

The present invention is a process for manufacturing a seamless tube, particularly a thin-walled seamless tube with a wall thickness of at most 4 mm such as a seamless tube for a pressure vessel including a tube for an air bag inflator, comprising subjecting a billet which has been soaked in a heating furnace at a predetermined temperature for a predetermined length of time to piercing and elongation rolling to form a mother tube, and after soaking the mother tube in a reheating furnace at a predetermined temperature for a predetermined length of time, subjecting the mother tube to sizing, characterized in that the soaking time in the heating furnace is at least [billet diameter (mm)×0.14] minutes and at most [billet diameter (mm)×0.35] minutes, and the soaking time in the reheating furnace is at least [mother tube wall thickness (mm)×3.0] minutes and at most [mother tube wall thickness (mm)×10.0] minutes.

Heretofore, the residence time in a heating furnace, soaking furnace, and reheating furnace has been determined from the standpoint of smoothly carrying out working in subsequent working steps. As described below, if the residence time is too long, it causes the occurrence of scale loss and scale-induced surface defects. Therefore, setting the residence time in a furnace to a longer value from a standpoint other than that described above had not been conceived of in the past based on the technological common knowledge of those skilled in the art.

According to the present invention, the occurrence of thickness deviations in a seamless tube can be effectively suppressed, and in particular, the wall thickness of a seamless tube for an air bag inflator can be reduced while ensuring that the tube has at least the minimum wall thickness demanded of a seamless tube for an air bag inflator.

The predetermined temperature in a heating furnace can be set to a suitable value in the range of at least 1150° C. and at most 1280° C. in accordance with the material properties of a billet and other factors. Similarly, the predetermined temperature in a reheating furnace can be set to a suitable value in the range of at least 850° C. and at most 1100° C. in accordance with the material properties of a mother tube, namely, the material properties of a billet and other factors.

In the present invention, in order to more effectively suppress thickness deviations, cold drawing is preferably performed on a tube after sizing, and the reduction ratio of the wall thickness in cold drawing is preferably at least 6% and at most 30%.

A seamless tube manufactured by a process according to the present invention can be suitably used as a pressure vessel such as an air bag inflator.

Effects of the Invention

In a process for manufacturing a seamless tube according to the present invention, the soaking time at a predetermined temperature in a heating furnace and the soaking time at a predetermined temperature in a reheating furnace are both optimized. Therefore, the occurrence of thickness deviations in a thin-walled seamless tube with a wall thickness of at most 4 mm such as a seamless tube for pressure vessels including a tube for air bag inflators can be effectively suppressed.

BEST MODE FOR CARRYING OUT THE INVENTION

Embodiment 1

Below, best modes for carrying out a process for manufacturing a seamless tube according to the present invention will be explained in detail while referring to the accompanying drawings. In the following explanation of embodiments, an example will be given of the case in which a seamless tube is intended for use as a pressure vessel and in particular as an air bag inflator, which is one example of applications of a thin-walled seamless tube.

Figure 1:
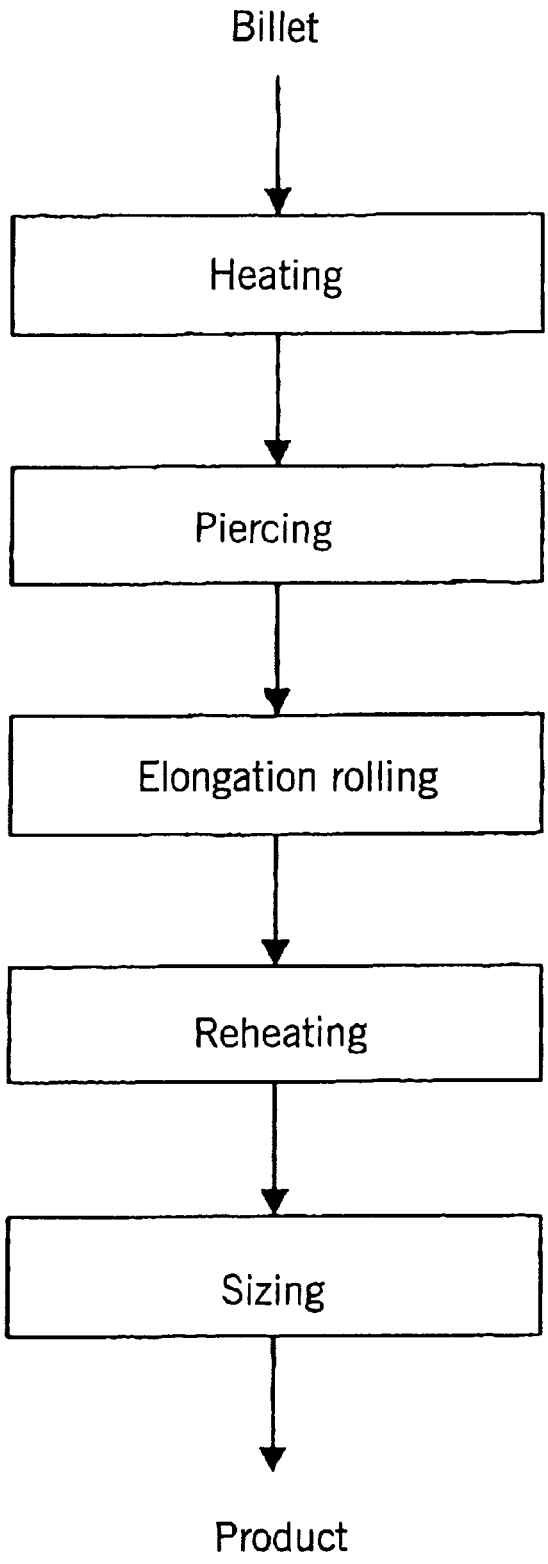
FIG. 1 is an explanatory view showing the steps employed in a process for manufacturing a seamless tube according to a first embodiment of the present invention.

FIG. 1 is an explanatory view showing the steps employed in a process for manufacturing a seamless tube according to this embodiment.

As shown in this figure, in this embodiment, a billet which is a raw material is heated in a rotary hearth heating furnace. The reasons for selecting the composition of a billet used in this embodiment will be explained. In this specification, unless otherwise specified, % means percent by weight.

C: 0.05-0.20%

When at least 0.05% of C is contained, the strength demanded of steel can be inexpensively obtained. However, if the C content exceeds 0.20%, the workability and weldability of steel are deteriorated and the toughness thereof decreases. Therefore, the C content is preferably at least 0.05% and at most 0.20%.

Si: at Most 0.50%

If Si is contained in excess of 0.50%, it impairs the cold workability of steel. Therefore, the Si content is preferably at most 0.50%.

Mn: 0.20-2.10%

By containing at least 0.20% of Mn, the strength and toughness of steel are increased, but an Mn content exceeding 2.10% adversely affect the weldability thereof. Therefore, the Mn content is preferably at least 0.20% and at most 2.10%.

P: at Most 0.020%

When more than 0.020% of P is contained, it brings about a decrease in toughness caused by grain boundary segregation. Therefore, the P content is preferably at most 0.020%.

S: at Most 0.010%

When greater than 0.010% of S is contained, it combines with Mn in steel to form inclusions in the form of MnS, which bring about a decrease in workability and a decrease in weldability and toughness (particularly in the circumferential direction of a tube). Therefore, the S content is preferably at most 0.010%.

Al: at Most 0.060%

Al is an element which is effective for improving the workability of steel, but if the Al content exceeds 0.060%, the toughness of welds decreases due to alumina-based inclusions. Therefore, the Al content is preferably at most 0.060%.

A billet used in this embodiment may further contain, as optionally added elements, at least one of Cr: at most 2.0%, Ni: at most 0.50%, Cu: at most 0.50%, Mo: at most 1.0%, Nb:

at most 0.10%, B: at most 0.005%, V: at most 0.10%, and Ti: at most 0.10%. These optionally added elements will also be explained.

Cr: at Most 2.0%

Cr is an element which is effective for enhancing the strength and corrosion resistance of steel. However, a Cr content exceeding 2.0% decreases the workability of steel and causes the formation of scale, which is a strongly adhered hard scale, thereby making it easy to develop scar-like scale-induced surface defects on the outer surface. This may become a major problem, particularly in the manufacture of a thin-walled seamless tube for an air bag inflator having a wall thickness of at most 4 mm. Therefore, when Cr is added, its content is preferably at most 2.0% and still more preferably at most 1.20%.

Ni: at Most 0.50%

Ni has the effect of increasing the toughness of steel and improving the hardenability thereof. However, Ni is an expensive element and particularly when the Ni content exceeds 0.50%, there is a marked increase in costs relative to the resulting effect. In addition, it causes the formation of scale, which is liable to develop scale-induced surface defects, and this may become a major problem, particularly in the manufacture of a thin-walled seamless tube for an air bag inflator having a wall thickness of at most 4 mm. Therefore, when Ni is added, its content is preferably at most 0.50%. In order to adequately improve low temperature toughness, the lower limit of the Ni content is preferably 0.05%.

Cu: at Most 0.50%

Cu is an element which is effective for improving the corrosion resistance and strength of steel. However, if the Cu content exceeds 0.50%, it worsens the hot workability of steel, and it causes scale to form thereby making it easy to develop scale-induced surface defects, which may become a major problem, particularly in the manufacture of a thin-walled seamless tube for an air bag inflator having a wall thickness of at most 4 mm. Therefore, when Cu is added, its content is preferably at most 0.50%. In order to adequately improve low temperature toughness, the lower limit on the Cu content is preferably 0.05%.

Mo: at Most 1.0%

Mo provides an increase in strength by solid solution strengthening and increases the hardenability of steel. However, if the Mo content exceeds 1.0%, the toughness of welds decreases at the time of welding. Therefore, when Mo is added, its content is preferably at most 1.0%, and still more preferably it is at most 0.50%.

Nb: at Most 0.10%

Like Ti, Nb is effective at increasing the toughness of steel by refining crystal grains, but if the Nb content exceeds 0.10%, it ends up worsening the toughness. Therefore, when Nb is added, its content is preferably at most 0.10%.

B: at Most 0.005%

B is an element which is effective for improving the hardenability of steel, but if the B content exceeds 0.005%, it causes precipitates to form along crystal grain boundaries, thereby decreasing the toughness of steel. Therefore, when B is added, its content is preferably made at most 0.005%.

V: at Most 0.10%

V has the effect of increasing the strength of steel by forming precipitates, but if the V content exceeds 0.10%, the toughness of welds decreases. Therefore, when V is added, its content is preferably at most 0.10%.

Ti: at Most 0,10%

Ti is effective at increasing the toughness of steel by refining crystal grains, but if the Ti content exceeds 0.10%, the toughness ends up worsening. Accordingly, when Ti is added, its content is preferably at most 0.10%.

One of these optional added elements can be added alone, or two or more of these can be added in combination.

The remainder other than the above elements is Fe and unavoidable impurities.

In this embodiment, a billet having the above-described composition undergoes piercing with a plug and grooved rolls of a piercer to produce a hollow shell body.

Next, a mandrel bar is inserted into the interior of the hollow shell body, and the hollow shell body is elongated by an elongator to form a mother tube while the outer surface of the hollow shell body is gripped by grooved rolls of the elongator, thereby reducing the wall thickness of the hollow body to a predetermined value.

The mandrel bar is then pulled out of the mother tube, and after reheating the mother tube in a reheating furnace, the mother tube is subjected to sizing to a predetermined outer diameter by a reducer such as a stretch reducer.

In this manner, a thin-walled seamless tube with a wall thickness of at most 4 mm is manufactured in this embodiment.

In this embodiment, the soaking time (duration of soaking) of a billet in a heating furnace at a predetermined temperature (1200° C. in this embodiment) is at least [billet diameter (mm)×0.14] minutes and at most [billet diameter (mm)×0.35] minutes, and the soaking time of a mother tube in a reheating furnace at a predetermined temperature (980° C. in this embodiment) is at least [mother tube wall thickness (mm)×3.0] minutes and at most [mother tube wall thickness (mm)×10.0] minutes. The reasons therefor will be briefly explained.

If the soaking time for which a billet is heated in a heating furnace is too short, the billet is unevenly heated, and large thickness deviations develop at the time of piercing. On the other hand, if the soaking time is too long, a large amount of scale develops on the surface of the billet so that operation becomes uneconomical due to scale loss, and a desired wall thickness can no longer be obtained.

If the soaking time in a reheating furnace prior to sizing is too short, the mother tube is unevenly heated and deformation at the time of sizing becomes uneven, so thickness deviations increase. On the other hand, if the soaking time is too long, a large amount of scale develops on the surface of the mother tube and scar-like scale-induced surface defects easily develop on the outer surface. In particular, when the billet contains Cr, Ni, and/or Cu as an optional added element, a strongly adhered hard scale is formed, and scale-induced surface defects may easily occur.

Below, the reasons why the soaking times in a heating furnace and in a reheating furnace are limited as described above will be explained in further detail.

Figure 2:
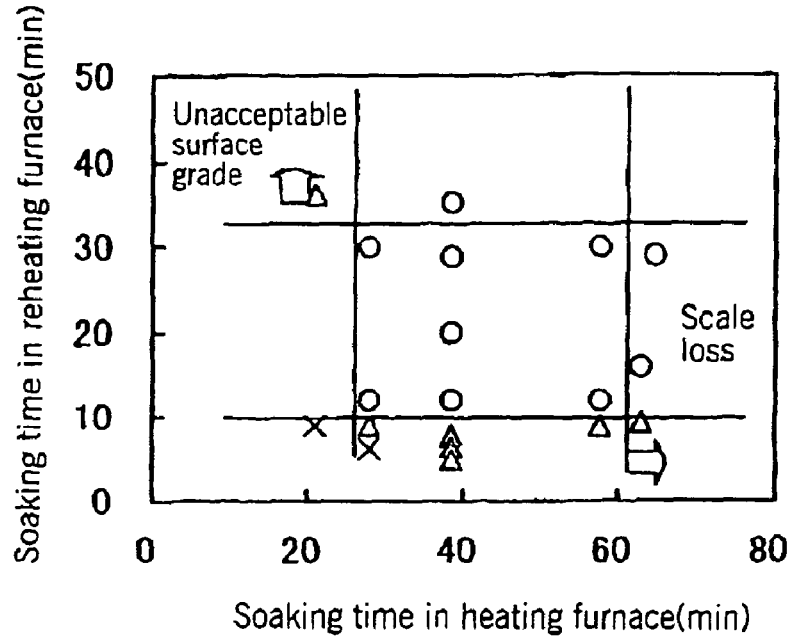
FIG. 2 are graphs showing the results of an investigation of the relationship between the soaking time and the amount of thickness deviation in products obtained when the soaking time in a heating furnace and the soaking time in a reheating furnace were varied.
Figure 2:
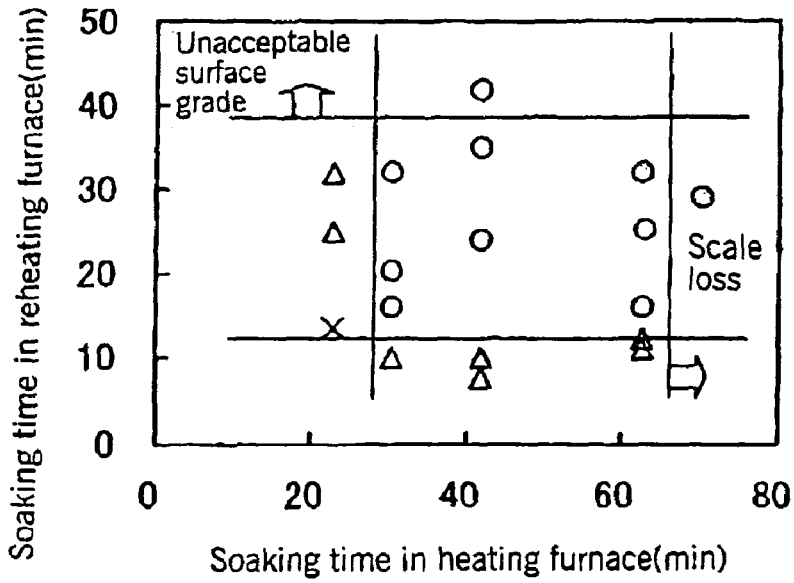

FIG. 2 are graphs showing the results of an investigation of the relationship between the soaking times in a heating furnace and in a reheating furnace and the amount of thickness deviation of a product when the soaking time in a heating furnace and the soaking time in a reheating furnace were varied. In the graphs of FIG. 2, the abscissa show the soaking time (minutes) of a billet in a heating furnace and the ordinate show the soaking time (minutes) of a mother tube in a reheating furnace. FIG. 2(*a*) shows the results obtained when the billet diameter was 175 mm and the wall thickness of the mother tube prior to reheating was 3.2 mm, and FIG. 2(*b*) shows the results obtained when the billet diameter was 190 mm and the wall thickness of the mother tube prior to reheating was 3.8 mm.

The composition of the billet was C: 0.10%, Si: 0.27%, Mn: 1.31%, P: 0.011%, S: 0.003%, Cr: 0.10%, Ni: 0.3%, Cu:

0.2%. Al: 0.04%, and a remainder of Fe and unavoidable impurities. As stated above, the soaking temperature in the heating furnace was set at 1200° C. and the soaking temperature in the reheating furnace was set at 980° C.

In the graphs of FIG. 2, data plotted by a CIRCLE (O) indicate the case when the amount of thickness deviation was at most 0.4 mm, data plotted by a TRIANGLE (Δ) indicate the case when the thickness deviation was larger than 0.4 mm and smaller than 1.0 mm, and data plotted by an "X" indicate the case when the thickness deviation was 1.0 mm or larger. The amount of thickness deviation was determined by measuring the difference between the maximum value and the minimum value of the wall thickness in cross section of a product over the entire length thereof and taking the maximum difference as the amount of thickness deviation.

As shown in the graph of FIG. 2(*a*), if the soaking time in the heating furnace is at least 25 minutes and at most 61 minutes and the soaking time in the reheating furnace is at least 10 minutes and at most 32 minutes, the amount of thickness deviation is always CIRCLE indicating that the occurrence of thickness deviations can be effectively suppressed.

Also as shown in the graph of FIG. 2(*a*), when the soaking time in the heating furnace exceeds 61 minutes, although there are cases in which the amount of thickness deviation is CIRCLE, a large amount of scale develops on the surface of the billet and due to scale loss, operation becomes uneconomical, so it is not desirable. Similarly, when the soaking time in the reheating furnace exceeds 33 minutes, although there are cases in which the amount of thickness deviation is CIRCLE, a large amount of scale develops on the surface of the mother tube, and scar-like scale-induced surface defects develop on the outer surface of the tube, which is not desirable. Accordingly, in this embodiment, the soaking times in the heating furnace and the reheating furnace are selected so as to fall within the above-described ranges.

The soaking time in a heating furnace can be selected depending on the diameter of a billet, while the soaking time in a reheating furnace can be selected depending on the wall thickness of a mother tube. Specifically, an appropriate soaking time of a billet in a heating furnace corresponds to a time of at least 0.14 minutes and at most 0.35 minutes per unit diameter of the billet, and an appropriate soaking time of a mother tube in a reheating furnace corresponds to a time of at least 3.0 minutes and at most 10.0 minutes per unit wall thickness of the mother tube. Below, the reasons therefor will be explained.

Heat transfer in a billet in a heating furnace and heat transfer in a mother tube in a reheating furnace are primarily governed by thermal radiation. Here, it will be assumed that the temperatures within a heating furnace and within a reheating furnace are constant, that heating is uniform in all directions, and that the surface condition of a billet and a mother tube which are the objects being heated is uniform, The amount of heat transfer Q1 by thermal radiation is proportional to the surface area of the object being heated and is calculated by the following Equation 1.

$$Q1 = A \times (\pi \times D \times L) \tag{1}$$

In Equation 1, A is a constant, T is the circular constant (Ludolph's number), D is the outer diameter of the object being heated, and L is the length of the object being heated. The surface areas of the end surfaces of the object being heated are sufficiently small compared to the outer surface area, so they are ignored in Equation 1. When the object being heated is a mother tube, the length of the mother tube is sufficiently long and the flow of atmospheric gas which is heated is small, so the inner surface is ignored in Equation 1.

The heat capacity Q2 of the object being heated (the amount of heat necessary to increase its temperature by 1° C.) is calculated by the following Equation 2 when the object being heated is a billet or by the following Equation 3 when the object being heated is a mother tube.

$$Q2 = c \times W = c \times \pi \times (D/2)^2 \times L \times w \tag{2}$$

$$\begin{aligned} Q2 &= c \times W = c \times \pi \times [(D/2)^2 - (D/2 - t)^2] \times L \times w \\ &= c \times \pi \times (tD - t^2) \times L \times w \end{aligned} \tag{3}$$

In Equations 2 and 3, c indicates the specific heat, W indicates the weight of the object being heated, t indicates the wall thickness, and w indicates the specific gravity of the object being heated.

The ease of increasing the temperature of the object being heated can be expressed by the ratio (Q1/Q2). Accordingly, the ease of increasing the temperature when the object being heated is a billet can be calculated by the following Equation 4 derived from Equations 1 and 2.

$$\begin{aligned} Q1/Q2 &= [A \times (\pi \times D \times L)]/[c \times \pi \times (D/2)^2 \times L \times w] \\ &= \text{constant}/D \end{aligned} \tag{4}$$

Equation 4 indicates that the soaking time of a billet in a heating furnace can be selected as a function of the diameter D of the billet (normalized in terms of the diameter of the billet).

The ease of increasing the temperature when the object being heated is a mother tube can be calculated by the following Equation 5 derived from Equations 1 and 3.

$$\begin{aligned} Q1/Q2 &= [A \times (\pi \times D \times L)]/[c \times \pi \times (tD - t^2) \times L \times w] \\ &= \text{constant}/(D/tD - t^2)) \end{aligned} \tag{5}$$

In Equation 5, t is small compared to D, so if the term $t^2$ is ignored, Equation 5 can be rewritten as Equation 5'.

$$Q1/Q2 = \text{constant}/t \tag{5'}$$

From the above consideration, it was found that the soaking time of a mother tube in a reheating furnace can be selected as a function of the wall thickness t of the mother tube according to Equation 5' (normalized in terms of the wall thickness t of the mother tube).

For the above-described reasons, the soaking time of a billet in a heating furnace can be set depending on the diameter of the billet, and the soaking time of a mother tube in a reheating furnace can be set depending on the wall thickness of the mother tube.

Similarly, in the case shown in FIG. 2(*b*), it can be seen that if the soaking time in a heating furnace is at least 27 minutes and at most 66 minutes and the soaking time in a reheating furnace is at least 12 minutes and at most 38 minutes, the amounts of thickness deviation are all CIRCLE, and the occurrence of thickness deviations can be effectively suppressed.

Also in the case shown in the graph of FIG. 2(*b*), the amount of thickness deviation is sometimes CIRCLE even when the soaking time in the heating furnace or the soaking time in the reheating furnace is above the above-described range, but as stated above, this is not desirable from the standpoints of scale loss and scale-induced surface defects. Accordingly, the soaking time of a billet in the heating furnace and the soaking time of a mother tube in the reheating furnace are preferably set so as to fall within the above-described ranges, which correspond to a soaking time of at least 0.14 minutes and at most 0.35 minutes per unit diameter of the billet and at least 3.0 minutes and at most 10.0 minutes per unit wall thickness of the mother tube, respectively.

From the above results, in a manufacturing process according to this embodiment, the soaking time of a billet at a predetermined temperature (1200° C. in this embodiment) in a heating furnace is at least [billet diameter (mm)×0. 14] minutes and at most [billet diameter (mm)×0.35] minutes, and the soaking time of a mother tube at a predetermined temperature (980° C. in this embodiment) in a reheating furnace is at least [mother tube wall thickness (mm)×3.0] minutes and at most [mother tube wall thickness (mm)×10.0] minutes.

Thus, in accordance with this embodiment, the amount of wall thickness deviation in a thin-walled seamless tube for an air bag, inflator having a wall thickness of at most 4 mm can be suppressed extremely effectively to at most 0.4 mm. Therefore, the tolerance of the wall thickness of a seamless tube for an air bag inflator can be as low as approximately 10% of the target value of the wall thickness.

Embodiment 2

Figure 3:
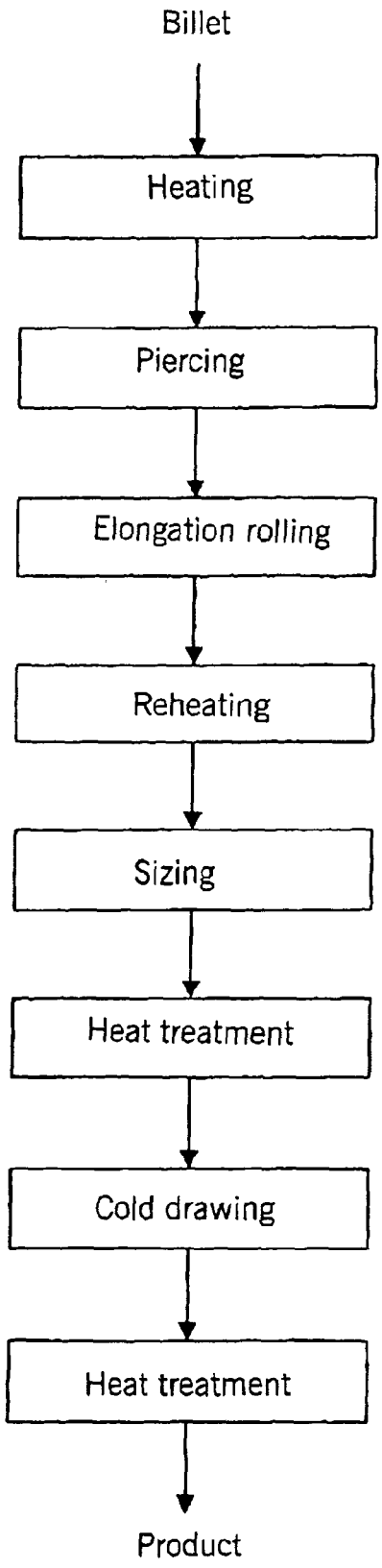
FIG. 3 is an explanatory view showing the steps employed in a process for manufacturing a seamless tube according to a second embodiment of the present invention.

FIG. 3 is an explanatory view showing the steps employed in a process for manufacturing a seamless tube according to a second embodiment.

As shown in this figure, also in this embodiment, a billet is subjected to piercing to form a hollow shell body, which is then elongated to form a mother tube, and the mother tube is subjected to sizing to a predetermined outer diameter using a reducer such as a stretch reducer in the same manner as in the first embodiment. Namely, this embodiment is also intended for the manufacture of a thin-walled seamless tube having a wall thickness of at most 4 mm after sizing. Likewise, the soaking time of a billet in a heating furnace at a predetermined temperature (1200° C. in this embodiment) is at least [billet diameter (mm)×0.14] minutes and at most [billet diameter (mm)×0.35] minutes, while the soaking time of a mother tube in a reheating furnace at a predetermined temperature (980° C. in this embodiment) is at least [mother tube wall thickness (mm)×3.0] minutes and at most [mother tube wall thickness (mm)×10.0] minutes. As a result, the amount of thickness deviation in a thin-walled seamless tube for an air bag inflator with a wall thickness of at most 4 mm can be suppressed extremely effectively to at most 0.4 mm. Therefore, the tolerance of the wall thickness of a seamless tube for an air bag inflator can be as low as approximately 10% of the target value of the wall thickness.

In this embodiment, in order to suppress thickness deviations even more effectively, cold drawing is carried out on the tube after sizing. Specifically, a seamless tube which has undergone sizing is subjected to heat treatment such as quenching from 900° C. followed by tempering at 500° C., and cold drawing is then carried out thereon. Thereafter, the cold-drawn tube is subjected to heat treatment for stress relief at 550° C., for example, to obtain a seamless tube product.

The reduction ratio of the wall thickness (%) of a tube in the cold drawing, namely, the difference between the wall thickness of the tube prior to cold drawing and after cold drawing divided by the wall thickness of the tube prior to cold drawing and multiplied by 100 is preferably set to at least 6% and at most 30%. Below, the reasons for this range will be explained.

Figure 4:
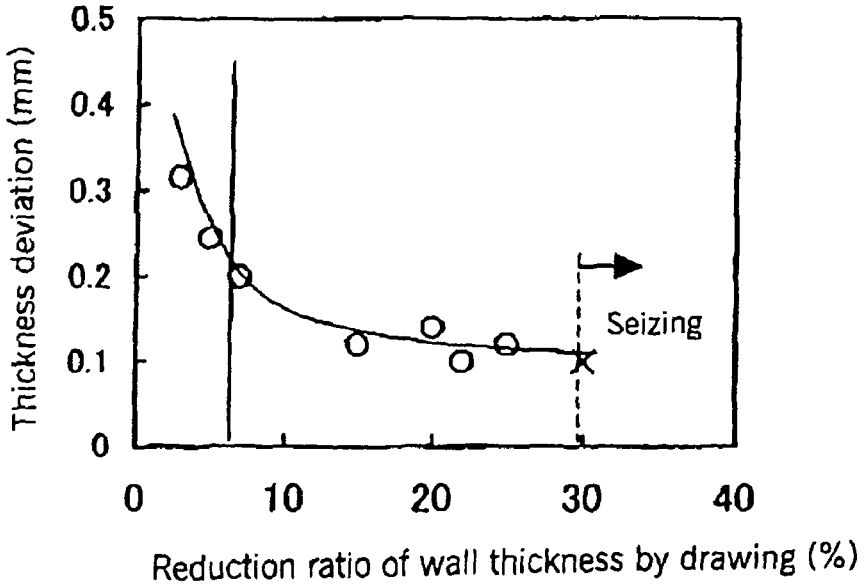
FIG. 4 is a graph showing the results of an investigation of the relationship between the reduction ratio of the wall thickness and the amount of thickness deviation in a product when the reduction ratio of the wall thickness in cold drawing was varied.

FIG. 4 is a graph showing the results of an investigation of the relationship between the reduction ratio of the wall thickness and the amount of thickness deviation of a product when tubes were subjected to cold drawing with different reduction ratios of the wall thickness (%).

In the graph of FIG. 4, the abscissa shows the reduction ratio of the wall thickness in cold drawing, and the ordinate shows the amount of thickness deviation of a product. The data shown in the graph of FIG. 4 were obtained for the case in which a tube with an outer diameter of 70 mm and a wall thickness of 3.2 mm was subjected to cold drawing to obtain a product with an outer diameter of 60 mm and a wall thickness in the range of from 3.1 mm (corresponding to a reduction ratio of the wall thickness of 3%) to 2.2 mm (corresponding to a reduction ratio of the wall thickness of 30%). The amount of thickness deviation was evaluated by measuring the difference between the maximum value and the minimum value of the wall thickness in cross section of a product after cold drawing over the entire length thereof and taking the maximum difference as the amount of thickness deviation.

As shown in the graph of FIG. 4, if the reduction ratio of the wall thickness is too small, a sufficient reduction of the wall thickness cannot be achieved, so the thickness deviation cannot be sufficiently eliminated by cold drawing. On the other hand, if the reduction ratio of the wall thickness is too large, the friction between the inner surface of the tube and a tool becomes so large that seizing may take place. Therefore, in order to more effectively suppress thickness deviations without the occurrence of seizing, the reduction ratio of the wall thickness is preferably set to at least 6% and at most 30%.

Figure 5:
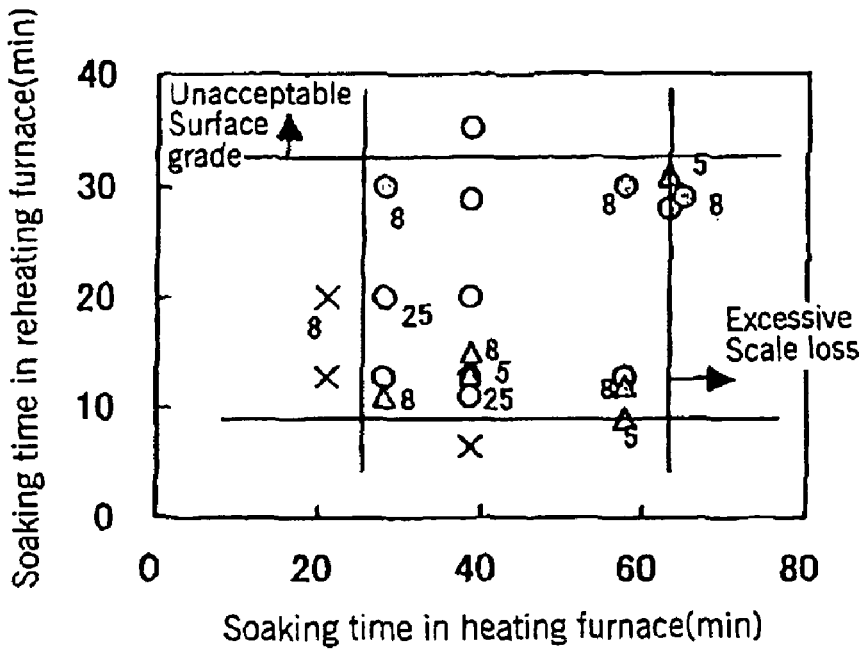
FIG. 5 are graphs showing the results of an investigation of the relationship between the soaking time and the reduction ratio of the wall thickness and the amount of thickness deviation of products obtained when the soaking time in a heating furnace and the soaking time in a reheating furnace were varied and the reduction ratio of the wall thickness in cold drawing was also varied in the second embodiment.
Figure 5:
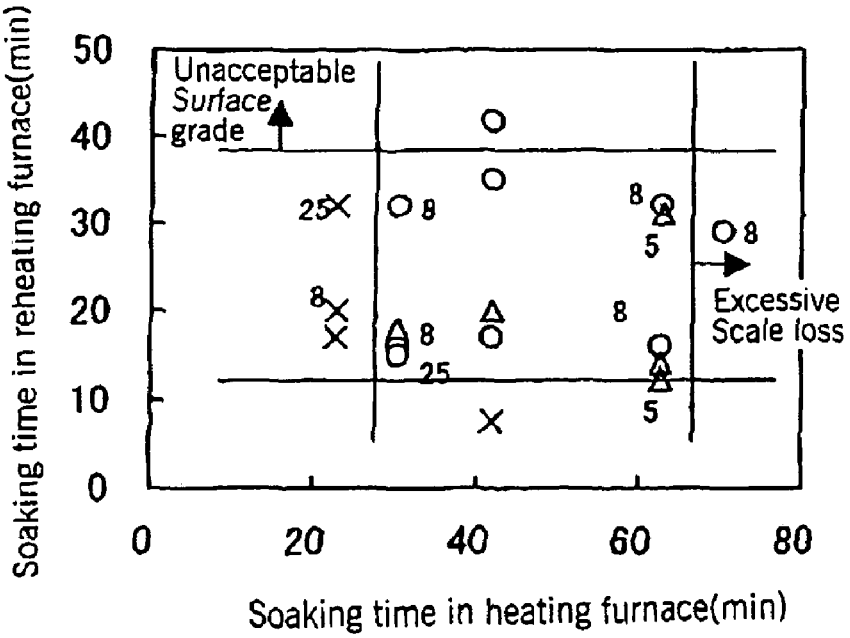

FIG. 5 are graphs showing the results of an investigation of the relationship between the soaking times in a heating furnace and a reheating furnace at different reduction ratios of the wall thickness and the amount of thickness deviation of the resulting product when the soaking time in a heating furnace and the soaking time in a reheating furnace were varied in the same manner as in the first embodiment and the reduction ratio of the wall thickness in cold drawing was 5, 8, 12, or 25%.

In the graphs of FIG. 5, the abscissa is the soaking time of a billet in a heating furnace, and the ordinate is the soaking time of a mother tube in a reheating furnace. FIG. 5(*a*) shows the results obtained when the diameter of a billet was 175 mm, the wall thickness of a mother tube before reheating was 3.2 mm, the outer diameter of a product after cold drawing was 50 mm, and the wall thickness of the product after cold drawing was 2.5 mm, and FIG. 5(*b*) shows the results obtained when the diameter of a billet was 190 mm, the wall thickness of a mother tube before reheating was 3.8 mm, the outer diameter of a product after cold drawing was 50 mm, and the wall thickness of the product after cold drawing was 2.5 mm.

In this example, a billet comprising C: 0.10%, Si; 0.27%, Mn: 1.31%, P: 0.011%, S: 0.003%, Cr: 0.10%, Ni: 0.3%, Cu: 0.2%, Al: 0.04%, and a remainder of Fe and unavoidable impurities was used. The soaking temperature in a heating furnace was set at 1200° C., and the soaking temperature in a reheating furnace was set at 980° C. In the graphs of FIG. 5, data plotted by a CIRCLE (O) indicate a wall thickness deviation of at most 0.20 mm, data plotted by a TRIANGLE (Δ) indicate a wall thickness deviation of at least 0.21 mm and at most 0.30 mm, and data plotted by an X indicate a wall thickness deviation of at least 0.31 mm. The amount of wall thickness deviation was evaluated by measuring the difference between the maximum value and the minimum value of the wall thickness in cross section of a product over its entire length and taking the maximum difference as the amount of thickness deviation. The numbers written in the vicinity of the plots in FIG. 5 indicate the reduction ratio of wall thickness (%). The plots not accompanied by these numbers are data for which the reduction ratio of the wall thickness was 12%.

As shown in FIG. 5(*a*), in the same manner as for the first embodiment shown in FIG. 2(*a*), the amount of thickness deviation could always be made CIRCLE or TRIANGLE and the occurrence of thickness deviation could be effectively suppressed by employing a soaking time in a heating furnace of at least 25 minutes and at most 61 minutes and a soaking time in a reheating furnace of at least 10 minutes and at most 32 minutes.

Furthermore, by setting the reduction ratio of the wall thickness in cold drawing to be in the range of at least 6% and at most 30% such as 8, 12, or 25%, whereas the amount of thickness deviation was TRIANGLE for each case in which the reduction ratio of the wall thickness was set to 5% which is outside of this range, the frequency with which the amount of thickness deviation was CIRCLE increased, and it can be seen that thickness deviations could be more effectively suppressed. FIG. 5(*b*) illustrates exactly the same situation.

Thus, according to this embodiment, the amount of thickness deviation of a thin-walled seamless tube for an air bag inflator having a wall thickness of at most 4 mm can be suppressed extremely effectively to at most 0.3 mm. Therefore, the tolerance of the wall thickness of a seamless tube for an air bag inflator can be as low as approximately 12% of the target value of the wall thickness.

The invention claimed is:

1. A process for manufacturing a steel seamless tube comprising subjecting a steel billet having a diameter which has been soaked in a heating furnace at a temperature of 1150-1280° C. for a predetermined length of time to piercing and elongation rolling to form a mother tube having a wall thickness, and after soaking the mother tube in a reheating furnace at a temperature of 850-1110° C. for a predetermined length of time, subjecting the mother tube to sizing to produce a steel seamless tube having a wall thickness of at most 4 mm, characterized in that the soaking time in the heating furnace is at least [billet diameter (mm)×0.14] minutes and at most [billet diameter (mm) ×0.35] minutes, and the soaking time in the reheating furnace is at least [mother tube wall thickness (mm)×3.0] minutes and at most [mother tube wall thickness (mm)×10.0] minutes.

2. A process for manufacturing a steel seamless tube as set forth in claim 1 characterized by subjecting the steel seamless tube which has undergone sizing to cold drawing.

3. A process for manufacturing a steel seamless tube as set forth in claim 2 characterized in that the cold drawing is performed such that the reduction ratio of the wall thickness is at least 6% and at most 30%.

4. A process for manufacturing a steel seamless tube as set forth in claim 3 characterized in that the steel seamless tube is intended for use as a pressure vessel.

5. A process for manufacturing a steel seamless tube as set forth in claim 4, wherein the seamless steel tube has a steel composition consisting essentially of:

C: 0.05-0.20%;
Si: at most 0.5%;
Mn: 0.20-2.10%;
P: at most 0.020%;
S: at most 0.010%;
Al: at most 0.060%;
Optionally at least one selected from the group of:
Cr: at most 2.0%, Ni: at most 0.50%, Cu at most 0.50%, Mo: at most 1.0%, Nb: at most 0.10%, B at most 0.005%, V; at most 0.10%, and Ti: at most 0.10%, the remainder of Fe and impurities.

6. A process for manufacturing a steel seamless tube as set forth in claim 5, wherein a wall thickness variation of the steel seamless tube is at most 0.4 mm.

7. A process for manufacturing a steel seamless tube as set forth in claim 2 characterized in that the steel seamless tube is intended for use as a pressure vessel.

8. A process for manufacturing a steel seamless tube as set forth in claim 7, wherein the seamless steel tube has a steel composition consisting essentially of:

C: 0.05-020%;
Si: at most 0.5%;
Mn: 0.20-2.10%;
P: at most 0.020%;
S: at most 0.010%;
Al: at most 0.060%;
Optionally at least one selected from the group of:
Cr: at most 2.0%, Ni: at most 0.50%, Cu at most 0.50%, Mo: at most 1.0%, Nb: at most 0.10%, B at most 0.005%, V; at most 0.10%, and Ti: at most 0.10%, the remainder of Fe and impurities.

9. A process for manufacturing a steel seamless tube as set forth in claim 8, wherein a wall thickness variation of the steel seamless tube is at most 0.4 mm.

10. A process for manufacturing a steel seamless tube as set forth in claim 2, wherein a wall thickness variation of the steel seamless tube is at most 0.4 mm.

11. A process for manufacturing a steel seamless tube as set forth in claim 7, wherein a wall thickness variation of the steel seamless tube is at most 0.3 mm.

12. A process for manufacturing a steel seamless tube as set forth in claim 1 characterized in that the steel seamless tube is intended for use as a pressure vessel.

13. A process for manufacturing a steel seamless tube as set forth in claim 12, wherein the seamless steel tube has a steel composition consisting essentially of:

C: 0.05-0.20%;
Si: at most 0.5%;
Mn: 0.20-2.10%;
P: at most 0.020%;
S: at most 0.010%;
Al: at most 0.060%;
Optionally at least one selected from the group of:
Cr: at most 2.0%, Ni: at most 0.50%, Cu at most 0.50%, Mo: at most 1.0%, Nb: at most 0.10%, B at most 0.005%, V; at most 0.10%, and Ti: at most 0.10%, the remainder of Fe and impurities.

14. A process for manufacturing a steel seamless tube as set forth in claim 13, wherein a wall thickness variation of the steel seamless tube is at most 0.4 mm.

* * * * *